US008689979B2

(12) United States Patent
Rowe

(10) Patent No.: US 8,689,979 B2
(45) Date of Patent: Apr. 8, 2014

(54) CUTLERY TRAY ASSEMBLY

(76) Inventor: Grant M. Rowe, Markham (CA)

( * ) Notice: Subject to any disclaimer, the term of this patent is extended or adjusted under 35 U.S.C. 154(b) by 139 days.

(21) Appl. No.: 13/299,635

(22) Filed: Nov. 18, 2011

(65) Prior Publication Data

US 2013/0126387 A1 May 23, 2013

(51) Int. Cl.
*B65D 1/34* (2006.01)

(52) U.S. Cl.
USPC ..... 206/553; 206/561; 220/523

(58) Field of Classification Search
USPC ..... 206/528, 553, 541, 561, 564; 220/523, 220/524, 525, 826, 837
See application file for complete search history.

(56) References Cited

U.S. PATENT DOCUMENTS

| | | | | |
|---|---|---|---|---|
| 1,354,211 | A * | 9/1920 | Reed | 206/38 |
| 1,939,497 | A | 12/1933 | Herring | |
| 2,366,046 | A | 12/1944 | Naken | |
| 2,710,094 | A | 6/1955 | Rau | |
| 3,412,890 | A | 11/1968 | Rich | |
| 4,412,616 | A * | 11/1983 | Williams | 220/524 |
| 4,418,823 | A * | 12/1983 | Romick | 206/538 |
| 4,940,143 | A | 7/1990 | Stanfield | |
| 4,979,610 | A | 12/1990 | Thomas | |
| 5,064,088 | A * | 11/1991 | Steffes | 220/837 |
| D353,078 | S | 12/1994 | Davis et al. | |
| 5,628,552 | A | 5/1997 | O'Barr | |
| 6,050,442 | A * | 4/2000 | Wysocki | 220/524 |
| D527,229 | S | 8/2006 | Joy | |
| 7,290,661 | B1 | 11/2007 | DeFino | |
| D562,641 | S | 2/2008 | Dretzka | |
| D569,196 | S | 5/2008 | Angel et al. | |
| 7,954,664 | B2 * | 6/2011 | Cronin et al. | 220/819 |
| 2008/0073241 | A1 | 3/2008 | Naden et al. | |
| 2009/0032538 | A1 * | 2/2009 | Lee et al. | 220/525 |

FOREIGN PATENT DOCUMENTS

| | | | | |
|---|---|---|---|---|
| CA | 2664654 | A1 | 4/2008 | |
| CA | 135031 | | 11/2010 | |
| EP | 0104280 | A1 | 4/1984 | |
| GB | 2252898 | A * | 8/1992 | B65F 1/04 |

* cited by examiner

*Primary Examiner* — David Fidei
(74) *Attorney, Agent, or Firm* — Boyle Fredrickson, S.C.

(57) ABSTRACT

A cutlery tray assembly having a first tray and a cover. The first tray has a plurality of partitions defining a plurality of compartments for holding cutlery. The cover has a first cover section hingedly attached to one end of the first tray, and a second cover section attached to the first cover section by a living or piano hinge. At least one side tab is positioned on the first cover section and is adapted to releasably attach to a respective point on the tray to hold the first cover section in a closed position. At least one other tab is positioned on the second cover section and is adapted to releasably attach to a respective point on the tray to keep the second cover section in a closed position independent of the at least one side tab. Furthermore, a second tray may be hingedly attached to the bottom of the first tray for holding household items.

22 Claims, 7 Drawing Sheets

CUTLERY TRAY ASSEMBLY

FIELD OF THE INVENTION

The present invention relates to cutlery trays.

BACKGROUND OF THE INVENTION

Kitchen drawers are used to store various household items. Typically one kitchen drawer, located in an easily accessible location in the kitchen, is used to hold an assortment of items, such as cutlery, utensils, gadgets and other kitchen aids, which the homeowner tends to use more frequently than other items. However, such an assortment of dissimilar items results in a disorganized drawer which makes finding specific items somewhat frustrating. Furthermore, since the drawer is in frequent use, there is a tendency for it to collect dirt, crumbs and the like, which falls into the drawer from the counter. As can be appreciated once such kitchen debris makes its way into the drawer it comes into contact with the exposed assortment of items and contaminates them, which is undesirable.

Attempts have been made to organize cutlery in kitchen drawers with cutlery trays. Some examples of known cutlery trays can be found in U.S. Design Pat. Nos. D353,078, D527,229, D562641, and D569,196; and U.S. Patent Application Publication No. 2008/0073241.

U.S. Pat. No. 7,290,661 to DeFino is a further example of a cutlery tray which attempts to deal with the issue of debris contaminating cutlery in the kitchen drawer by providing a roll-top closure. However, the roll-top closure of the DeFino cutlery tray is complicated and prone to breaking and jamming. Moreover, the roll-top mechanism increases the vertical height of the DeFino tray relative to conventional cutlery trays, which makes for an inefficient use of the available space in the most important kitchen drawer.

In view of the above, there is a continuing need for improvements in cutlery tray designs. What is desired is a cutlery tray which is simple and inexpensive to manufacture, and is capable of organizing typical items held in kitchen drawers, efficiently, taking advantage of the average 3¾ to 4 inch clearance height of typical kitchen drawers, and which protects items placed therein from contamination by common kitchen debris.

SUMMARY OF THE INVENTION

Preferred embodiments of the present invention will address at least some of the problems with prior art cutlery trays. One preferred embodiment of the present invention is a cutlery tray assembly which will fit into a standard kitchen drawer, and which includes two stacked trays hingedly attached together with a cover hingedly attached to the topmost tray. The compartments are configured to hold items such as cutlery, spice containers, medicine/wellness product containers, cosmetic containers, hand tools, and batteries. The cover is preferably sufficiently transparent for items to show through, and divided into two sections with a hinge, for example a living hinge or a piano hinge, permitting one group of compartments in the topmost tray to be closed independently of a second group of compartments. Preferably, one section of the cover will cover the one group of compartments and a portion of the second group of compartments to form a barrier preventing the items in the second group of compartments from sliding out when the tray is tilted up.

According to another embodiment a member is slidably attached to the bottom tray of the cutlery tray assembly to form an adjustable compartment for holding additional items and to facilitate widthwise fitment of the cutlery tray assembly in a kitchen drawer.

Therefore, according to one aspect of an embodiment of the present invention there is disclosed a cutlery tray assembly, comprising:

- a first tray having a plurality of partitions defining a plurality of compartments for holding items; and
- a cover to cover said plurality of compartments, said cover comprising:
  - a first cover section hingedly attached to one end of said first tray, said hinged attachment defining a hinge axis, and
  - a second cover section hingedly attached to said first cover section;
  - at least one side tab positioned on said first cover section adapted to releasably attach to a respective point on said tray to hold said first cover section in a closed position;
  - at least one other tab positioned on said second cover section adapted to releasably attach to a respective point on said tray to keep said second cover section in a closed position independent of said at least one side tab.

According to another aspect of the present invention said first tray has a bottom edge and a top edge associated with said one end, and said cutlery tray assembly further comprises a second tray having a plurality of partitions defining a plurality of compartments for holding items, said second tray having a top edge hingedly attached to said bottom edge of said first tray.

According to yet another aspect of the present invention said first tray has a side, and said cutlery tray assembly further comprises a member slidably attached to said second tray and configured to define, in combination with said second tray, an adjustable compartment, wherein said slidable member has a bottom wall, upstanding side walls extending from said bottom wall, and a side opening configured to slidably receive said side of said second tray. It is also contemplated that the cutlery tray assembly further comprises a pair of channels formed in said one end and at an end opposite to said one end of said tray, said pair of channels being configured to slidably engage complementary flanges extending in matching relation from top edges of said upstanding side walls.

BRIEF DESCRIPTION OF THE DRAWINGS

Reference will now be made to the preferred embodiments of the present invention with reference, by way of example only, to the following drawings in which.

DETAILED DESCRIPTION OF THE PREFERRED EMBODIMENTS

The present invention is described in more detail with reference to exemplary embodiments thereof as shown in the appended drawings. While the present invention is described below including preferred embodiments, it should be understood that the present invention is not limited thereto. Those of ordinary skill in the art having access to the teachings herein will recognize additional implementations, modifications, and embodiments which are within the scope of the present invention as disclosed and claimed herein. In the figures, like elements are given like reference numbers. For the purposes of clarity, not every component is labelled in every figure, nor is every component of each embodiment of the invention shown where illustration is not necessary to allow those of ordinary skill in the art to understand the invention.

Figure 1:
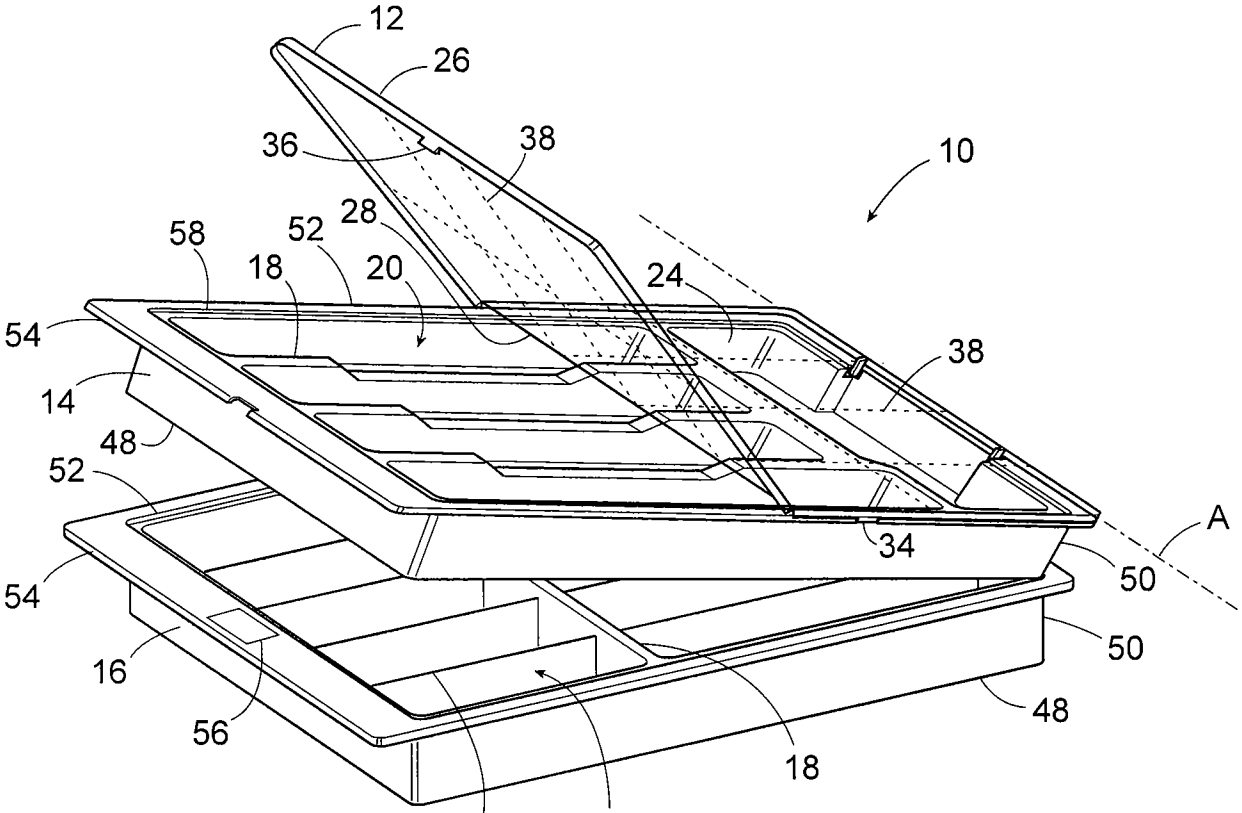
FIG. 1 is a perspective view of a cutlery tray assembly according to an embodiment of the present invention with a first tray and cover in partially open positions.
Figure 3:
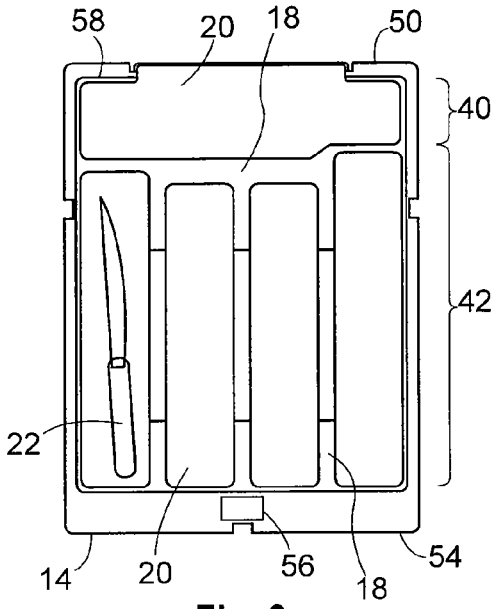
FIG. 3 is a top view of a first tray of the cutlery tray assembly of FIG. 1.
Figure 4:
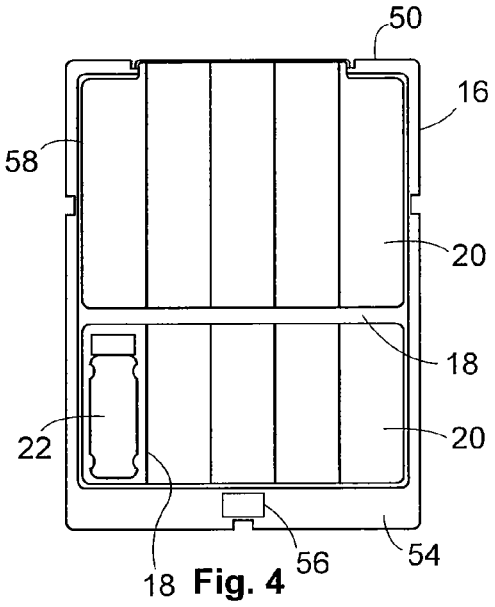
FIG. 4 is a top view of a second tray of the cutlery tray assembly of FIG. 1.
Figure 5:
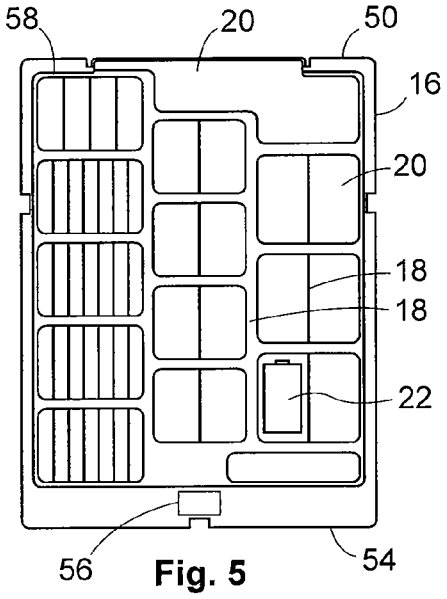
FIG. 5 is a top view of another second tray of the cutlery tray assembly of FIG. 1.

A cutlery tray assembly according to one embodiment is shown generally in FIG. 1 with reference numeral 10. The cutlery tray assembly is shown with a cover 12 attached to a first tray 14 which is in turn attached to a second tray 16. As best seen in FIGS. 3 to 5, each of the first and second trays 14, 16 have partitions 18 which define compartments for holding items 22. Preferred embodiments of the present invention will have the first and second trays 14, 16 configured to hold household items such as cutlery (i.e. knives, forks, soup spoons, tea spoons, etc), small containers (i.e. spice containers, medicine/wellness product containers, cosmetic containers, and the like), hand tools (i.e. screw drivers, utility knives, pliers, scissors, wrenches, etc.), and batteries. Accordingly, FIG. 3 shows a preferred configuration of partitions 18 defining compartments 20 for holding cutlery or hand tools. FIG. 4 shows a preferred configuration of partitions 18 defining compartments 20 for holding spice containers such as standard 50 g and 135 g McCormick®, ClubHouse® and Mrs. Dash® spice containers. FIG. 5 shows a preferred configuration of partitions 18 defining compartments 20 for holding assorted batteries. First and second trays 14, 16 are made according to known techniques including molding, injection molding, stamping, casting, milling, and the like. Accordingly, the materials for making the first and second trays 14, 16 will be selected according to the chosen method of manufacture and desired characteristics and properties in the final product. To minimize packaging and package size when shipping the manufactured first and second trays 14, 16, it is contemplated that in preferred embodiments of the present invention like trays will be nestable within one another. Preferred materials include plastic, wood, fiber, bamboo powder polymers, metal, and metal alloy. Preferred plastics include ABS and PVC.

Figure 2:
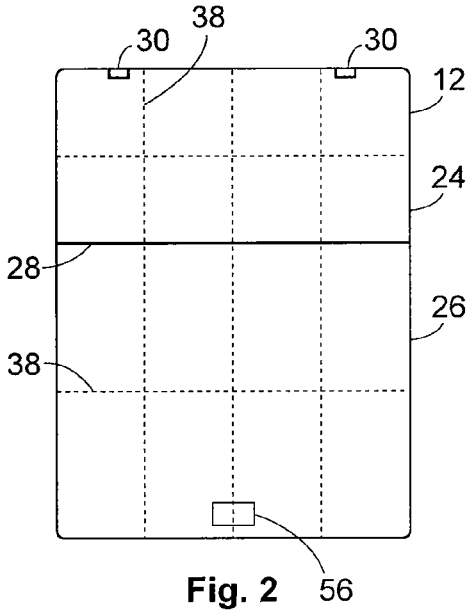
FIG. 2 is a top view of a cover of the cutlery tray assembly of FIG. 1.
Figure 8:
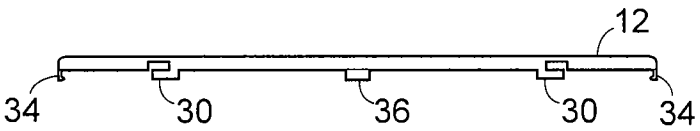
FIG. 8 is a rear view of the cover of FIG. 2.
Figure 11:
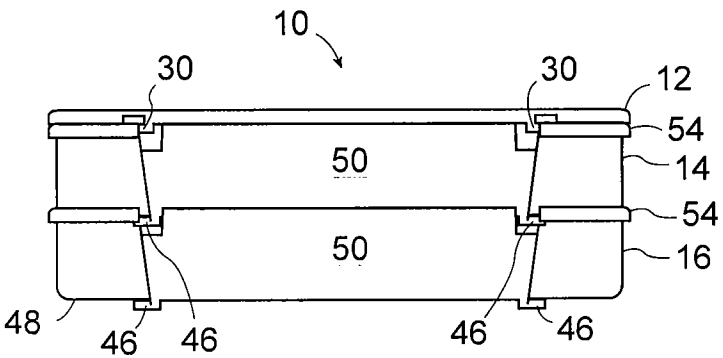
FIG. 11 is a back view of the cutlery tray assembly of FIG. 1 in a closed position.

The cover 12 is hingedly attached to the first tray 14. As will be appreciated, the cover 12 helps prevent contaminants from falling into the compartments 20 in the first tray 14 and onto the items 22 in the compartments 20. Preferably, the cover 12 is sufficiently transparent for the items to show through. However, the cover 12 need not be transparent. The cover 12 may also be tinted or coloured if desired. As best seen in FIG. 2 the cover 12 has a first cover section 24 and a second cover section 26. The first cover section 24 is attached to the second cover section 26 with a living hinge 28 which permits the first and second cover sections 26, 28 to bend relative to one another as discussed in more detail below. Alternately, the first cover section 24 may be attached to the second cover section 26 with a piano hinge (not shown), or the like. The living hinge 28 is shown as spanning the width of the cover and is substantially parallel to the to the hinge axis A of the cover 12 at the point of attachment to the back 50 of the first tray 14. As best seen in FIG. 8, the first cover section 24 of the cover 12 has posts 30 extending therefrom for pivotally attaching to corresponding receptacles 32 formed in the first tray 14. Preferably, the first cover section 24 includes a pair of side tabs 34 adapted to releasably attach to respective points on the first tray 14, by way of a friction fit, or snap fit, coupling, to keep the first cover section 24 in a closed position on the first tray 14. Good results have been obtained by positioning the side tabs 34 adjacent to the living hinge 28. Preferably the friction fit coupling will be configured to prevent opening of the first cover section 24 from the first tray 14 against the weight of items 22 contained in the compartments 20. According to the preferred embodiment, the second cover section 26 has at least one other tab 36 positioned thereon and adapted to releasably attach to a respective point on the first tray 14 to keep the second cover section 26 in a closed position on the first tray 14 independent of the side tabs 34. In this way, the second cover section 26 may be opened and closed independently of the first cover section 24.

It will now be understood that access to items 22 in compartments 20 of the first tray 14 covered by the second cover section 26 are accessible after decoupling or unsnapping tab 36 and lifting and tilting the second cover section 26 about living hinge 28. Access to items 22 in compartments covered by the first cover section 24 are accessible after further decoupling or unsnapping side tabs 34 and lifting and tilting the first and second cover sections 24, 26 about hinge axis A. Closing of the first and second cover sections 24, 26 is achieved by reversing the above steps.

As will be appreciated, the cover 12 may be provided with ribs 38 to increase its strength and stiffness. Furthermore, the edges of the cover 12 may be formed to engage the top edge of the first tray 14 to help prevent side to side movement of the cover 12. For example, the edges of the cover 12 may be curved to match a curved profile of the top edge of the first tray 14.

Figure 14:
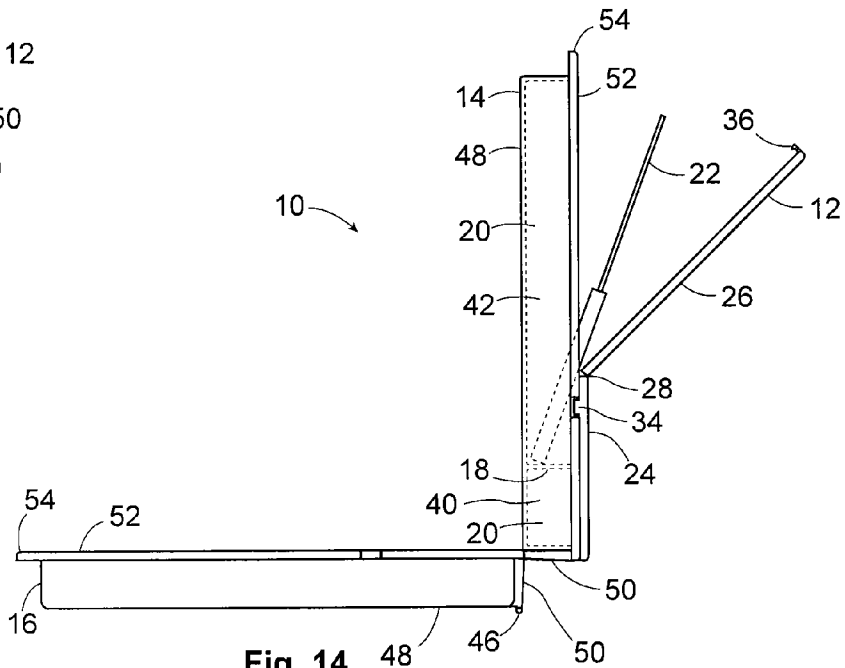
FIG. 14 is a side view of the cutlery tray assembly of FIG. 1 with the first tray in a fully open position, and the cover in a partially open position.
Figure 12:
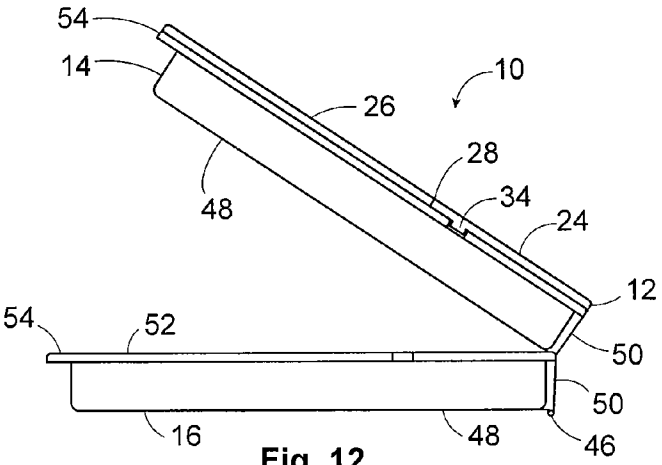
FIG. 12 is a side view of the cutlery tray assembly of FIG. 1 with the first tray in a partially open position, and the cover in a fully closed position.
Figure 13:
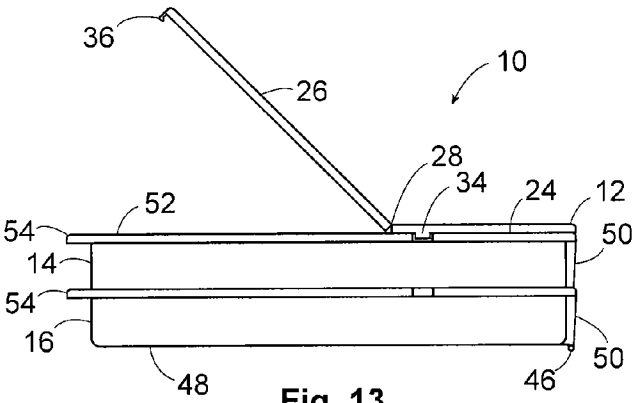
FIG. 13 is a side view of the cutlery tray assembly of FIG. 1 with the first tray in a closed position, and the cover in a partially open position.
Figure 16:
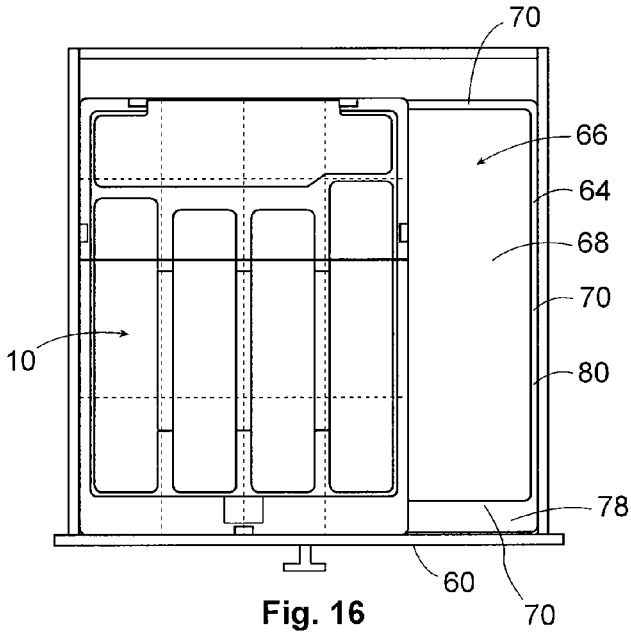
FIG. 16 is a top view of the cutlery tray assembly of FIG. 19 installed in a kitchen drawer.

Referring back to FIG. 3, it can be seen that the preferred first tray 14 has two groups of compartments, namely a first group of compartments 40 and a second group of compartments 42 adjacent to the first group of compartments 40. In FIG. 3, the first group of compartments 40 includes one compartment oriented parallel with the hinge axis of the cover 12, and the second group of compartments includes five compartments oriented perpendicular to the hinge axis of the cover 12. Preferably the five compartments oriented perpendicular to the hinge axis of the cover 12 have a length to accommodate standard cutlery or hand tools as the case may be. The preferred cover 12 has the first cover section 24 sized and shaped to cover at least the first group of compartments 40 and the second cover section 26 is sized and shaped to cover the second group of compartments 42. More preferably, however, the first cover section 24 of the cover 12 is sized and shaped to cover the first group of compartments 40 and a portion 44 of the second group of compartments 42, as best seen in FIGS. 14 and 16. Referring now to FIG. 14, it will be understood that covering a portion 44 of the second group of compartments 42 helps prevent the items from slipping out of the second group of compartments 42 when the first tray 14 is lifted up from the second tray 16, especially since it is contemplated that the hinged attachment of the first tray 14 to the second tray 16 may be configured to permit the first tray to tilt up to 90 degrees relative to the second tray 16. In this respect the preferred length of the portion 44 is between 5 and 40% of the average length of the compartments 20 in the second group of compartments 42. However, the most preferred length of the portion 44 will be 20% of the average length of the compartments 20 in the second group of compartments 42.

Figure 6:
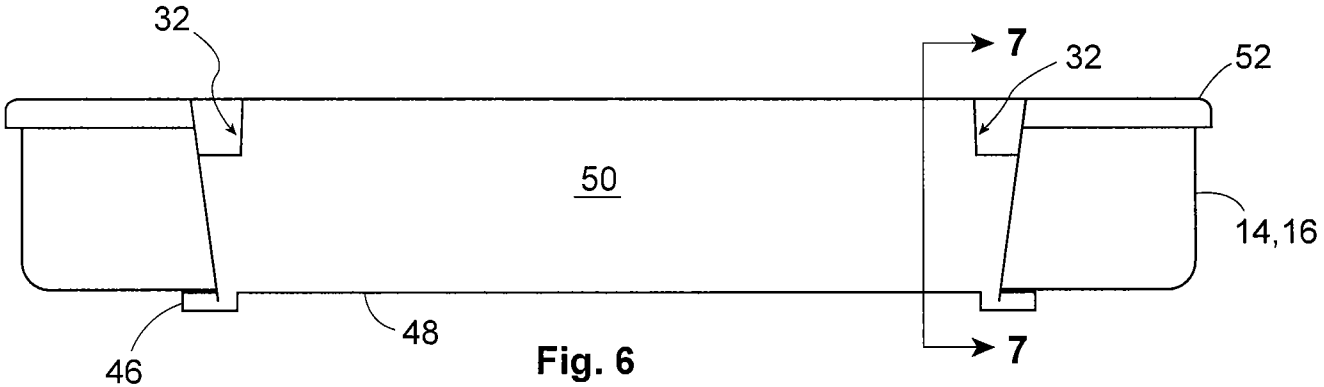
FIG. 6 is a rear view of any one of first and second trays of FIGS. 3 to 5.
Figure 7:
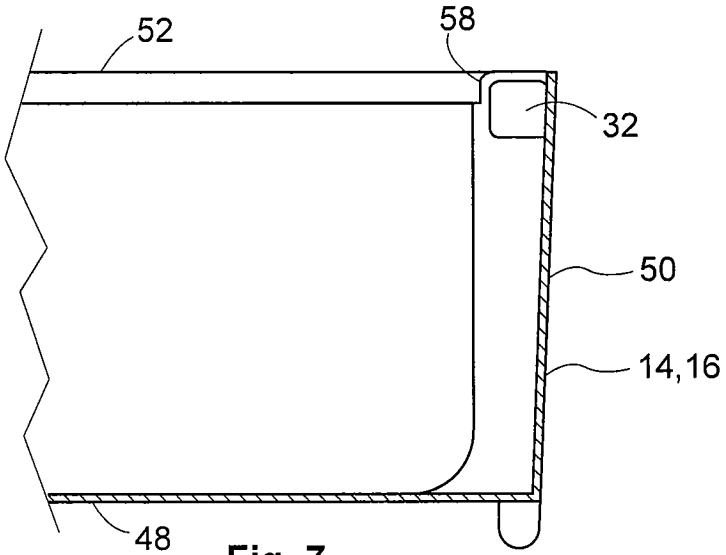
FIG. 7 is a cross-sectional view of the tray of FIG. 6 taken along line 7-7.
Figure 9:
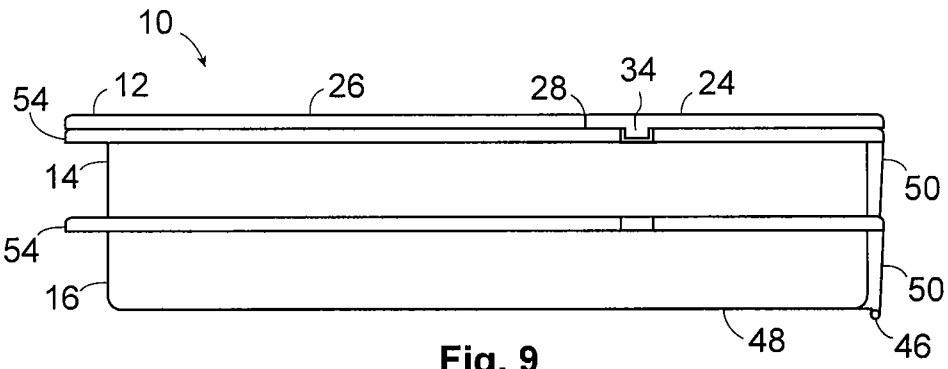
FIG. 9 is a side view of the cutlery tray assembly of FIG. 1 in a closed position.

As mentioned above, first and second trays 14, 16 of the cutlery tray assembly 10 are attached together, and as shown in FIG. 1, the attachment is a hinged attachment to permit the first tray 14 to tilt up from the second tray 16, enabling a user access to items 22 in compartments 20 of the second tray 16. Various forms of hinged attachments as comprehended by the present invention, and one example of such a hinged attachment is shown in FIGS. 6 and 7. However other examples include pneumatic piano-type hinges, posts, and rods, slide and lock/unlock channelling systems to permit holding and/or locking the first tray 14 at one or more angles relative to the second tray 16. The present invention further comprehends biasing means, such as a spring, to assist in lifting the first tray to an inclined position. However, reasonable results are achieved with a passive hinge arrangement It is preferred, according to the present invention, to put the higher demand items in the first tray 14, such as cutlery. While batteries, for example, are usefully stored below the first tray 14 in second tray 16. Typically, access to such batteries will not be as frequent as for the first tray 14 cutlery items. Thus the present invention comprehends placing the high demand items in the first tray 14. As can be appreciated it will be easier to bring the cover to an open position to access the first tray 14, than to lift the first tray 14 to an open position to expose the second tray.

Referring now to FIG. 6 it can be seen that the first trays 14 have pivot posts 46 extending from the bottom edges 48 of their back sides 50. The pivot posts 46 are configured to be received by complementary receptacles 32 formed in the top edges 52 of second trays 16. A lip 54 grippable with fingers is provided on the first tray 14 to facilitate tilting the first tray 14 up relative to the second tray 16. One or more logos 56 may be included on the lip 54 to identify the purpose of the tray and/or the manufacturer or vendor of the cutlery tray assembly 10.

As mentioned above, FIG. 8 shows cover 12 with pivot posts 30 are configured to be received by complementary receptacles 32 formed in the top edges 52 of first trays 14. Although not shown, it is contemplated that a third tray may be hingedly attached to the second tray 16 in a similar fashion. Furthermore a fourth tray may be hingedly attached to the third tray, and so forth for a multiple tray arrangement.

Figure 10:
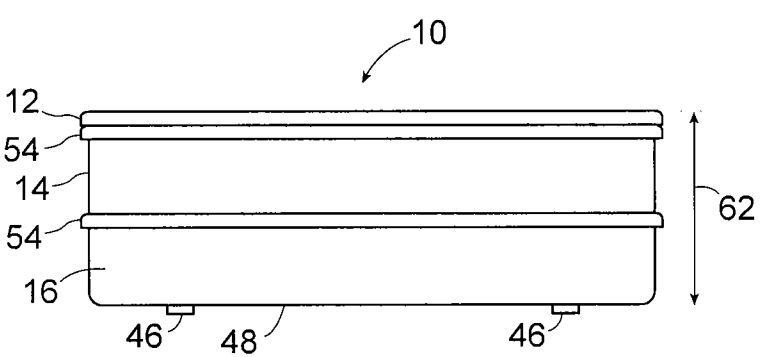
FIG. 10 is a front view of the cutlery tray assembly of FIG. 1 in a closed position.

As best seen in FIG. 10, the top edge 52 of the second tray 16 preferably includes a recess 58 to accommodate the bottom of the first tray 14. What is important is that the recess 58 helps prevent side to side movement of the first tray 14 relative to the second tray 16. Furthermore, the recess 58 will help prevent items 22 being visible in the second tray 16.

Referring now to FIGS. 9 to 14 it will now be understood that the cutlery tray assembly 10 has a closed and covered position (FIGS. 9-11), a partially open and covered position (FIG. 12), a closed and partially uncovered position (FIG. 13), a fully open and uncovered position (FIG. 14), a closed and fully uncovered position provide access to the first group of compartments 42 (not shown).

For fitment in a drawer 60 the preferred cutlery tray assembly 10 is provided with a height 62 that is ¼ inches less than the maximum headroom of the drawer 60. In this regard, it has been found that a typical kitchen drawer 60 has a maximum headroom of between 3¾ and 4 inches, meaning that a height 62 of 3½ inches provides sufficient clearance in most kitchen drawer 60.

Figure 15:
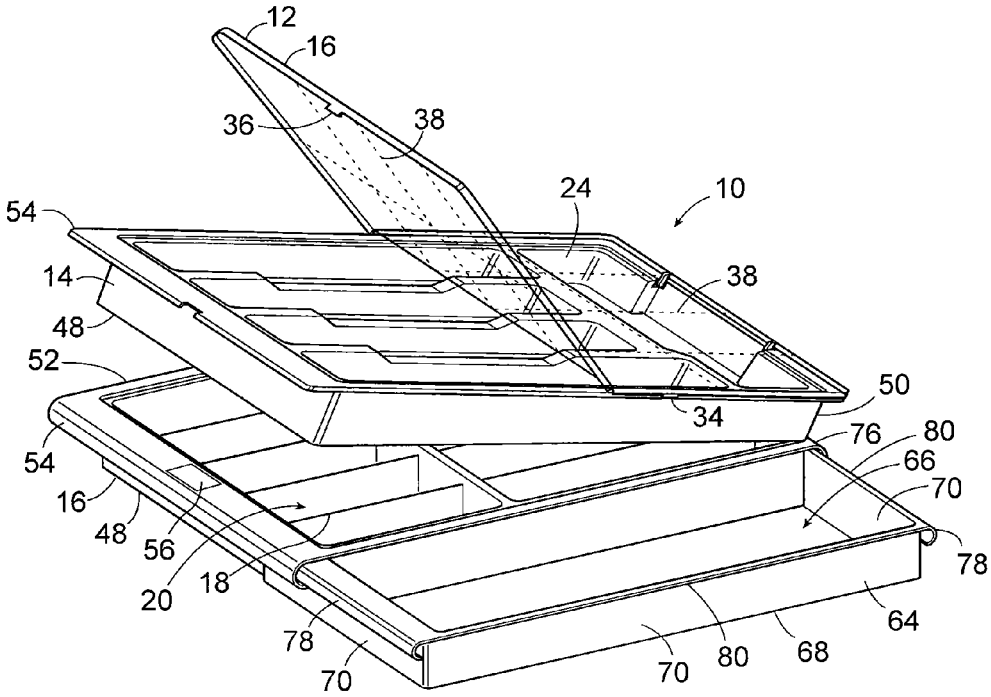
FIG. 15 is a perspective view of the cutlery tray assembly of FIG. 19 with the first tray, cover and slidable member in partially open positions.
Figure 18:
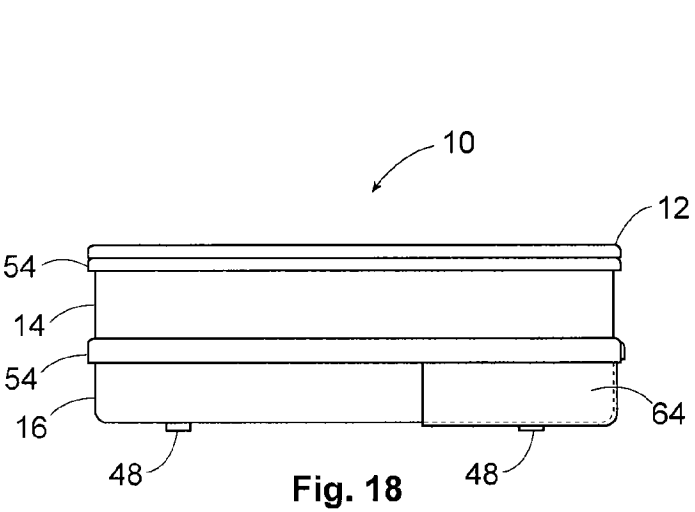
FIG. 18 is a front view of a cutlery tray assembly according to another embodiment of the present invention similar to FIG. 1 with the slidable member of FIG. 17 slidably attached to the second tray in a fully closed position.
Figure 17:
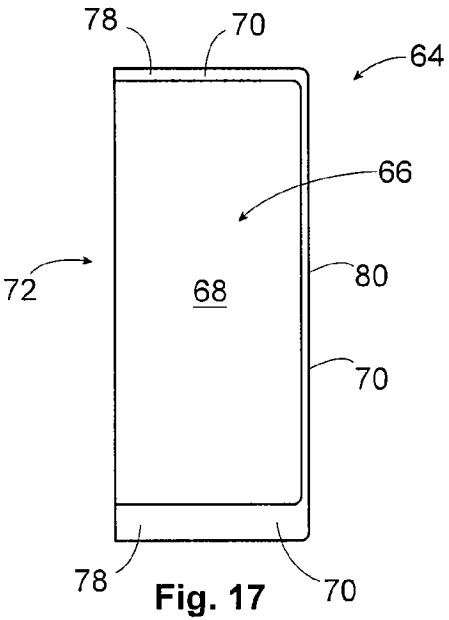
FIG. 17 is a top view of a slidable member according to another embodiment of the present invention.
Figure 20:
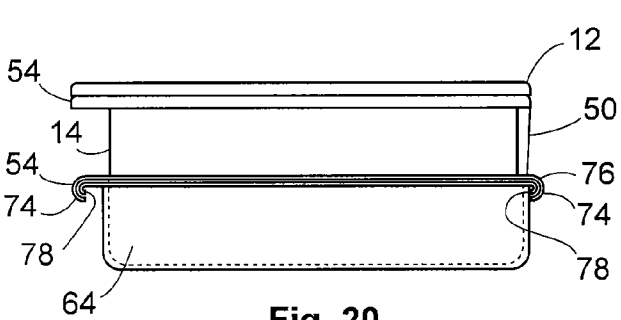
FIG. 20 is a side view of the cutlery tray assembly of FIG. 19.
Figure 19:
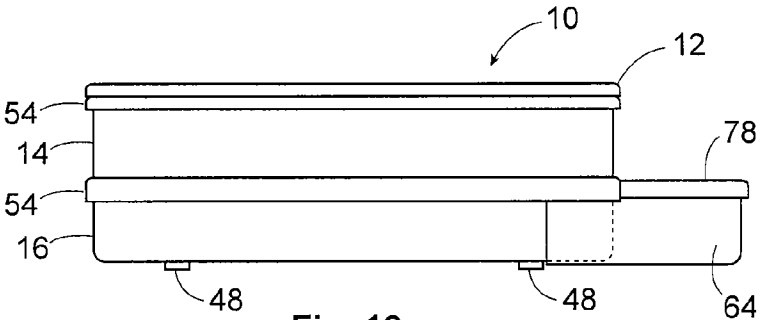
FIG. 19 is a front view of the cutlery tray assembly of FIG. 18 with the slidable member slidably attached to the second tray in an open position.

Referring now to FIG. 15, there is shown a cutlery tray assembly 10 according to another embodiment which further includes a member 64 slidably attached to the second tray 16 and configured to define, in combination with the second tray 16, an adjustable compartment 66 in the drawer 60 as best seen in FIG. 16. As shown in FIG. 17, the slidable member 64 has a bottom wall 68, upstanding side walls 70 extending from the bottom wall 68, and a side opening 72 configured to slidably receive the side of the second tray 16. Accordingly, FIG. 18 shows a front view of the cutlery tray assembly 10 with the slidable member 64 slidably attached to the second tray 16 in a fully closed position, and FIG. 19, shows the cutlery tray assembly 10 with the slidable member 64 in an open position. As best seen in FIG. 20, the second tray 16 has a pair of channels 74 formed in the front lip 54 and in a back lip 76, which channels are configured to slidably engage complementary flanges 78 extending in matching relation from top edges 80 of the upstanding side walls 70. Other embodiments of the present invention may include means to hold or lock the slidable member 64 in an open position, for example the channels 74 and complementary flanges 78 may be provided with one or a series of friction/interference fit or snap couplings, or an integrated gear rack and complementary ratchet. Alternately, a clamping means may be provided to permit locking the slidable member 64 in the open position. Additionally, grip means, such as for example rubber pads or strips, may be included on the outside edges of the slidable member 64 and the first or second tray 14, 16 to engage and grip the inner side walls of the drawer when the slidable member 64 is in an open position. In this way, the cutlery tray assembly 10 will be customizable to the width of the kitchen drawer 60 and prevented from sliding in the drawer 60 as the drawer is opened an closed which can be annoying.

While reference has been made to various preferred embodiments of the invention other variations, implementations, modifications, alterations and embodiments are comprehended by the broad scope of the appended claims. Some of these have been discussed in detail in this specification and others will be apparent to those skilled in the art. Those of ordinary skill in the art having access to the teachings herein will recognize these additional variations, implementations, modifications, alterations and embodiments, all of which are within the scope of the present invention, which invention is limited only by the appended claims.

The embodiments of the invention in which an exclusive property or privilege is claimed are defined as follows:

1. A cutlery tray assembly, comprising:

a first tray having a plurality of partitions defining a plurality of compartments for holding cutlery;

a cover to cover said plurality of compartments, said cover comprising:

a first cover section hingedly attached to one end of said first tray, said hinged attachment defining a hinge axis;

a second cover section hingedly attached to said first cover section;

at least one side tab positioned on said first cover section adapted to releasably attach to a respective point on said tray to hold said first cover section in a closed position; and at least one other tab positioned on said second cover section adapted to releasably attach to a respective point on said tray to keep said second cover section in a closed position independent of said at least one side tab; and a second tray hingedly attached to said one end of said first tray, said second tray having a plurality of partitions defining a plurality of compartments for holding items.

2. The cutlery tray assembly according to claim 1, wherein said second cover section is attached to said first cover section by a living hinge or a piano hinge.

3. The cutlery tray assembly according to claim 1, wherein said cover is sufficiently transparent for the items to show through.

4. The cutlery tray assembly according to claim 1, wherein said first tray has a bottom edge and a top edge associated with said one end, and said second tray has a top edge hingedly attached to said bottom edge of said first tray.

5. The cutlery tray assembly according to claim 1, wherein said items comprise cutlery, spice containers, medicine product containers, wellness product containers, cosmetic containers, tools, or batteries.

6. The cutlery tray assembly according to claim 1, wherein said hinged attachment of said first tray to said second tray is configured to permit said first tray to tilt up to 90 degrees relative to said second tray.

7. The cutlery tray assembly according to claim 1, wherein said plurality of compartments comprises a first group of at least one compartment adjacent to said one end, and a second group of at least one compartment adjacent to said first group of at least one compartment.

8. The cutlery tray assembly according to claim 7, wherein said first cover section of said cover is sized and shaped to cover at least said first group of at least one compartment, and said second cover section of said cover is sized and shaped to cover at least a portion of said second group of at least one compartment.

9. The cutlery tray assembly according to claim 8. wherein said first cover section of said cover is sized and shaped to cover said first group of at least one compartment and a portion of said second group of at least one compartment to prevent items in said second group of at least one compartment from sliding out when said first tray is tilted relative to said second tray.

10. The cutlery tray assembly according to claim 9, wherein said portion of said second group of at least one compartment covered by said first cover section is between 5% and 40% of the average length of said at least one compartment in said second group of at least one compartment.

11. The cutlery tray assembly according to claim 10, wherein said portion of said second group of at least one compartment covered by said first cover section is 20% of the average length of said at least one compartment in said second group of at least one compartment.

12. The cutlery tray assembly according to claim 11, wherein said first group of at least one compartments is oriented parallel with said hinge axis, and said second group of at least one compartments is oriented perpendicular to said hinge axis. and said second group of at least one compartments has a length to accommodate standard sized cutlery.

13. The cutlery tray assembly according to claim 1, wherein said first tray has a lip at an end opposite said one end to facilitate lifting said first tray with fingers.

14. The cutlery tray assembly according to claim 1, wherein said first tray has a side, and said cutlery tray assembly further comprises a member slidably attached to said second tray and configured to define, in combination with said second tray, an adjustable compartment.

15. The cutlery tray assembly according to claim 14, wherein said slidable member has a bottom wall, upstanding side walls extending from said bottom wall, and a side opening configured to slidably receive said side of said second tray.

16. The cutlery tray assembly according to claim 14, further comprising a pair of channels formed in said one end and at an end opposite to said one end of said tray, said pair of channels being configured to slidably engage complementary flanges extending in matching relation from top edges of said upstanding side walls.

17. The cutlery tray assembly according to claim 1, wherein said at least one side tab is configured to friction fit couple to said respective point on said tray with a force sufficient to hold said first cover section in a closed position against a weight of items in said first and second groups of compartments when said first tray is tilted relative to said second tray.

18. The cutlery tray assembly according to claim 1, comprising plastic, wood, fiber, bamboo powder polymers, metal, or metal alloy.

19. A cutlery tray assembly, comprising:

a first tray having a plurality of partitions defining a plurality of compartments for holding cutlery;

a cover to cover said plurality of compartments, said cover comprising:

a first cover section hingedly attached to one end of said first tray, said hinged attachment defining a hinge axis;

a second cover section hingedly attached to said first cover section;

at least one side tab positioned on said first cover section adapted to releasably attach to a respective point on said tray to hold said first cover section in a closed position; and at least one other tab positioned on said second cover section adapted to releasably attach to a respective point on said tray to keep said second cover section in a closed position independent of said at least one side tab; and wherein:

said plurality of compartments comprises a first group of at least one compartment adjacent to said one end, and a second group of at least one compartment adjacent to said first group of at least one compartment; and said first cover section of said cover is sized and shaped to cover said first group of at least one compartment and a portion of said second group of at least one compartment to prevent items in said second group of at least one compartment from sliding out when said first tray is tilted relative to said second tray.

20. The cutlery tray assembly according to claim 19, wherein said portion of said second group of at least one compartment covered, by said first cover section is between 5% and 40% of the average length of said at least one compartment said second group of at least one compartment.

21. The cutlery tray assembly according to claim 20, wherein said portion of said second group of at least one compartment covered by said first cover section is 20% of the average length of said at least one compartment in said second group of at least one compartment.

22. The cutlery tray assembly according to claim 21, wherein said first group of at least one compartments is oriented parallel with said hinge axis, and said second group of at least one compartments is oriented perpendicular to said hinge axis, and said second group of at least one compartments has a length to accommodate standard sized cutlery.

* * * * *